US005740638A

United States Patent [19]

Shepherd, III

[11] Patent Number: 5,740,638

[45] Date of Patent: Apr. 21, 1998

[54] COMBINATION DRAINAGE SYSTEM AND RADON GAS VENTING SYSTEM FOR A STRUCTURE FOUNDATION

[75] Inventor: Allen S. Shepherd, III, Plain City, Ohio

[73] Assignee: Shepherd Excavating, Inc., Dublin, Ohio

[21] Appl. No.: 804,711

[22] Filed: Feb. 21, 1997

[51] Int. Cl.[6] ..... E02D 1/92

[52] U.S. Cl. ..... 52/169.5; 52/302.1

[58] Field of Search ..... 52/169.1, 169.5, 52/169.14, 302.1, 302.3, 741.1; 405/36, 38, 43, 45, 50

[56] References Cited

U.S. PATENT DOCUMENTS

| | | | |
|---|---|---|---|
| 4,538,386 | 9/1985 | Di Cello | 52/169.5 |
| 4,622,790 | 11/1986 | Johannsson | 52/169.5 |
| 4,654,310 | 3/1987 | Thelen et al. | 404/31 |
| 5,003,750 | 4/1991 | Delgado | 405/43 X |
| 5,014,462 | 5/1991 | Malmgren et al. | 47/1.01 |
| 5,048,764 | 9/1991 | Flament | 241/36 |
| 5,100,258 | 3/1992 | Van Wagoner | 405/43 X |
| 5,277,003 | 1/1994 | Myers | 52/169.5 |
| 5,444,950 | 8/1995 | Kelly et al. | 52/169.5 |

*Primary Examiner*—Creighton Smith

*Attorney, Agent, or Firm*—John L. Gray; Kegler, Brown Hill & Ritter

[57] ABSTRACT

A combination drainage system and radon gas venting system for a structure foundation as disclosed which utilizes solid rubber particle fill as a free draining and venting medium.

12 Claims, 1 Drawing Sheet

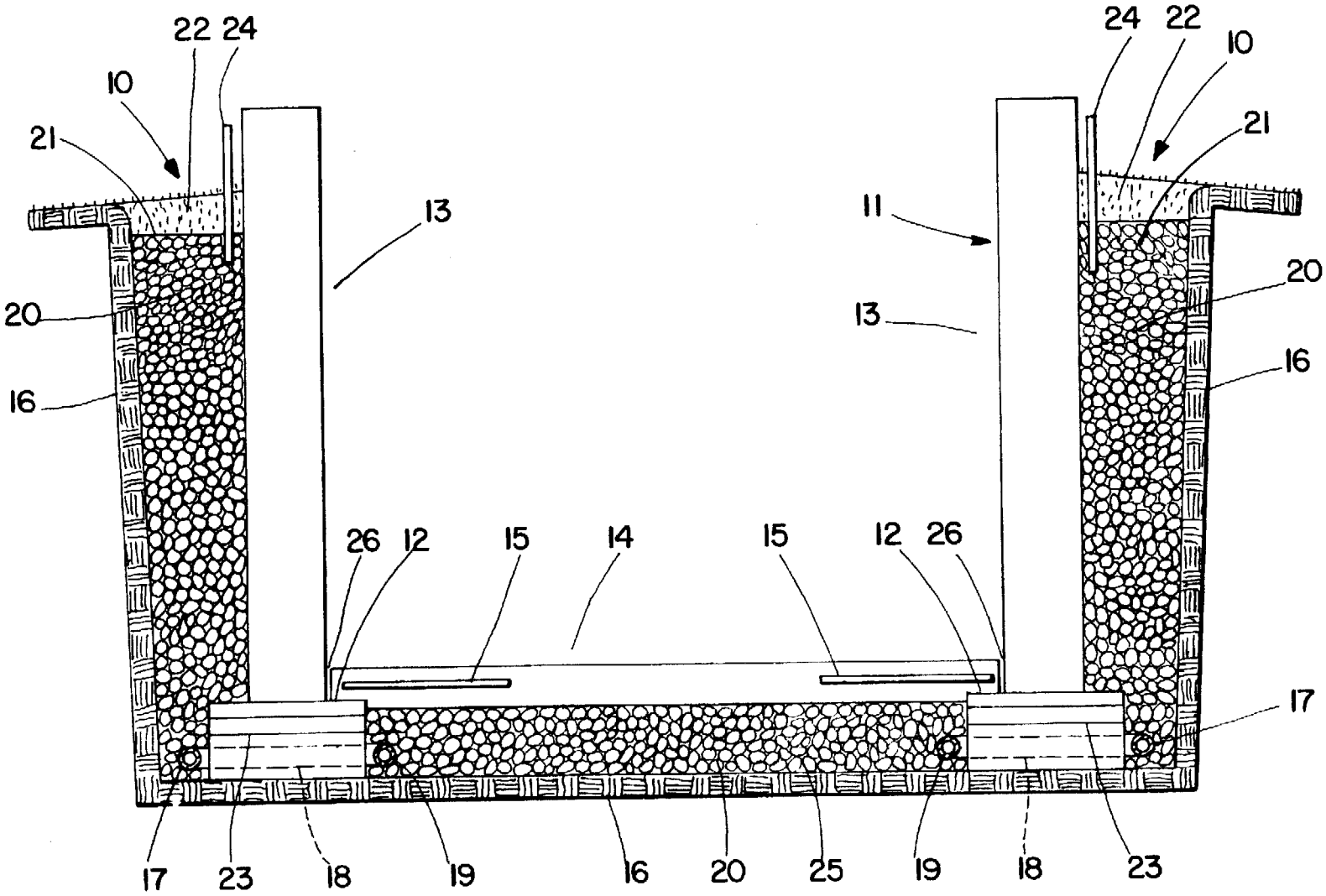
10
11
12
13
14
15
16
17
18
19
20
21
22
23
24
25
26

COMBINATION DRAINAGE SYSTEM AND RADON GAS VENTING SYSTEM FOR A STRUCTURE FOUNDATION

BACKGROUND OF THE INVENTION

The present invention is directed toward a combination drainage system and radon gas venting system for a structure's foundation. Applicant's co-pending patent application, U.S. Ser. No. 08/655,089, entitled A DRAINAGE SYSTEM FOR A STRUCTURE FOUNDATION sets forth the present state of the art with respect to structure foundation drainage systems.

Typical structure foundation drainage systems comprise an open volume, approximating a trench that surrounds a structure foundation and which extends down to the footer of the foundation. Drain tile is laid in the trench and gravel is added to cover the tile. It is to be understood that the term "tile" as used herein includes sections of tile that are laid in end to end relation leaving space for moisture to enter, as well as drain pipe having periodic openings along its length to accomplish the same purpose. Filter fabric may then be laid over the gravel and soil fill may be added over the filter fabric. However, the use of gravel as a porous fill media has many inherent problems.

Gravel is mined in quarries. The establishment of a quarry requires the complete destruction of any natural environment that may have existed upon the quarry site. Additionally, quarries can be a significant source of pollution. Quarries produce a significant amount of particulate air and water runoff pollution. Additionally, a large cost to the quarry operator is the transportation of the aggregate material to the production site. This transportation generally involves heavily loaded (and often overloaded) trucks. These trucks generate large amounts of pollution and detrimentally impact the road structures over which they travel.

The use of gravel as a porous fill media has many additional problems inherent in its use in drainage systems. Gravel absorbs and entrains moisture within the individual rocks. Such moisture offsets the air which was previously entrained in the gravel rocks. Air has a much lower thermal conductivity than water. Air has a thermal conductivity of approximately 0.014 while water has a thermal conductivity of approximately 0.343. [Marks' Standard Handbook for Mechanical Engineers, Ninth Edition 4-82–4-84 (1978) McGraw-Hill Book Company]. Therefore, as gravel absorbs water it tends to increase its thermal conductivity.

Radon gas which is produced from the decomposition of certain materials often found in the soil has relatively recently been recognized as a potential problem for many basements and structures. Prolonged exposure to radon gas can result in damage to individuals and in some communities laws have been enacted requiring the creation of a radon sump pit with an appropriate pump to pump out any accumulated waters underneath the basement slab that might contain dissolved radon gas.

BRIEF SUMMARY OF THE INVENTION

The present invention involves the use of solid rubber particles as a porous fill media in drainage systems for structure foundations located in the trench surrounding the foundation as well as underneath the basement slab in the structure. This, coupled with appropriate radon gas venting systems, will permit continuous exhaust of any accumulated radon gas and also provides the advantages of porous fill media in drain systems in combination with such radon gas exhausting systems.

In one embodiment of the present invention the solid rubber particles comprise chopped tires. Currently, discarded automotive tires pose serious problems. These tires are sometimes stockpiled in dumps. This stockpiling of these tires presents risks respecting health, environmental, and fire hazards. Tires are also disposed of in landfills. However, many governments have outlawed this type of disposal because of the many problems associated with landfill storage of tires. Rather than being disposed of by conventional means, the tires may be chopped up and utilized as the porous fill media in the drainage system of the present invention.

Rubber has a much lower modulus of elasticity than does gravel. The higher modulus of elasticity of gravel means that gravel deforms far less than rubber does when subjected to similar stresses. These characteristics are especially important in areas with expansive soils. Gravel will tend to transmit expansion forces directly into the adjacent structure foundation while rubber will tend to absorb the expansion forces and may direct such forces away from the adjacent structure foundation.

Because of its porous nature, gravel will also allow water to be transmitted to the structure foundation directly. As water is absorbed by the gravel rock it may be transmitted across individual rocks and eventually to the structure foundation through capillary action. Rubber, in its non-porous form, will not permit the transmission of water to the foundation to occur by capillary action through the rubber material.

Even when dry gravel has a higher thermal conductivity than rubber. Dry gravel has a thermal conductivity of 0.22 while vulcanized rubber has a thermal conductivity of 0.08. Id. at 4-84. The higher the thermal conductivity of a material the higher the heat transferred through that material. When gravel is placed adjacent a structure foundation and utilized as a porous fill material for a drain system the gravel tends to have a higher amount of heat transfer which occurs from the structure foundation to the surrounding soil.

In addition, gravel itself generates radon gas. Therefore, by eliminating gravel from adjacent the structure foundation and underneath the basement floor, an additional source of radon gas is eliminated.

By utilizing rubber particles both underneath the basement slab and in the trench that surrounds the structure foundation with appropriate venting connections leading to exhaust vents to the open atmosphere, any accumulations of radon gas will be continuously permitted to escape to the atmosphere.

It is therefore an object of this invention to provide a combination drainage system and radon gas venting system for a foundation utilizing rubber particles as fill in the trench adjacent the foundation and underneath the basement slab.

It is therefore a further object of this invention to provide such a drainage system wherein the rubber particles are made from used tires.

These together with other objects of the invention will become apparent from the following detailed description of the invention and the accompanying description of the drawings.

BRIEF DESCRIPTION OF THE DRAWINGS

The FIGURE is a cross-sectional view of one embodiment of the present invention.

DETAILED DESCRIPTION OF THE INVENTION

Referring to the FIGURE, one embodiment of a combination drainage and radon gas venting system is shown therein.

Trenches shown generally at 10—10 surrounds a conventional structure foundation 11 having concrete footers 12—12 and walls 13—13 as well as a basement floor 14 provided with reinforcing bars 15—15. The trenches 10—10 serves to separate the foundation walls 13—13 and footers 12—12 from the surrounding soil 16—16.

In the lower extent of the trenches 10—10 is drain tile 17—17 which serves to carry the moisture which is captured by the drainage system away from the foundation walls 13—13 and footers 12—12. It should also be noted that the drain tile 17—17 is connected by means of pipes 18—18 extending through the footers 12—12 to interior drain tiles 19—19 which are positioned underneath the concrete basement floor 14.

Solid rubber particle fill 20—20 is positioned in the trenches 10—10 between the soil 16 and the foundation walls 13—13 and footers 12—12 and is also positioned underneath the basement floor 14. Solid rubber particle fill 20—20 preferably surrounds the drain tiles 17—17 and 19—19 and fills a substantial portion of trenches 10—10 and the area underneath the concrete basement floor 14.

Optionally, filter fabric 21—21 is positioned over the solid rubber particle fill 20—20 and the remaining portion of trenches 10—10 may be filled with soil fill 22—22.

Equal-spaced at selected distances in the footer 12—12 are radon vents 23—23 which are located just under the basement floor 14 and connect the space underneath the basement floor with the filled area in the trenches 10—10 which has been filled with solid rubber particle fill 20—20. Radon vents 24—24 are located in the solid rubber particle fill 20—20 in the trenches 10—10 and exhaust to the open atmosphere. A vapor barrier 25 such as 4 mil VISQUEEN® may be used above the rubber particle fill 20—20 and under the basement floor 14. It is also preferable to caulk the joints 26—26 between the basement floor 14 and the foundation walls 13—13.

In operation, the water from the adjacent soils 16—16 and 22—22 will trickle down through the solid rubber particle fill 20—20 in the trenches 10—10 underneath the basement floor 14 into the drain tiles 19—19 and 17—17 where it will be transported away from the foundation walls 13—13 and the basement floor 14.

Likewise, any accumulation of radon gas underneath the basement floor 14 will be permitted to expand through the solid rubber particle fill 20—20 underneath the basement floor 14 through the vents 23—23 and then up through the solid rubber particle fill 20—20 and exhaust into the atmosphere through vents 24—24. This system will also vent the radon gas in the soil adjacent the foundation walls 13—13; namely, in the soils 16—16 on the sides of the trenches 10—10. In addition to permitting drainage of water and outflow of radon gases, this system also creates insulation for the basement walls and the floor, thus meeting the model energy code in many cases.

Although this invention has been shown and described with respect to detailed embodiments it will be understood by those skilled in the art that various changes in form and detail thereof may be made without departing from the scope of the claimed invention.

What is claimed is:

1. A combination drainage system and radon gas venting system comprising:

a structure foundation comprising foundation walls each having a base and an interior and exterior side, and connected by a concrete floor adjacent the base of said foundation walls;

a trench having a bottom lower than said concrete floor and adjacent the exterior of said foundation walls;

drain tile in said trench and under said concrete floor;

vents having intakes under said concrete floor and exhausting into said trench; and solid rubber particle fill under said concrete floor, solid rubber particle fill up to a level in said trench and covering said drain tile and said vents connected to said trench; and vents having intakes positioned below the level of said solid rubber particle fill in said trench and exhausting to the atmosphere.

2. The combination drainage system and radon gas venting system of claim 1, wherein said trench extends down to the base of said foundation walls and completely surrounds the exterior of said foundation walls.

3. The combination drainage system and radon gas venting system of claim 1, further comprising filter fabric covering of said solid rubber particle fill in said trench.

4. The combination drainage system and radon gas venting system of claim 1, wherein said drain tile extends along the bottom of said trench.

5. The combination drainage system and radon gas venting system of claim 1, wherein said solid rubber particle fill comprises shredded scrap tires.

6. The combination drainage system and radon gas venting system of claim 5, wherein said shredded scrap tires comprise particles having dimensions of approximately 2 inches by 2 inches by ½ inch.

7. The combination drainage system and radon gas venting system of claim 1, wherein said vents under said concrete floor connected to said trench are positioned immediately below said concrete floor.

8. A method of installing a combination drainage system and radon gas venting system in a structure foundation provided with foundation walls resting on a footer and connected by a concrete floor adjacent a base of said foundation walls comprising:

providing a trench surrounding said structure foundation walls to the footer of said foundation walls;

filling an area under said concrete floor prior to installing said concrete floor with solid rubber particle fill;

placing a first layer of solid rubber particle fill in said trench;

providing vents having intakes under said concrete floor exhausting into said trench;

placing drain tile on said first layer of solid rubber particle fill in said trench;

placing a second layer of solid rubber particle fill in said trench to cover said drain tile and also to cover an exhaust portion of said vents under said concrete floor; and providing vents having intakes positioned below a level of said solid rubber particle fill in said trench and exhausting to the atmosphere.

9. The method of claim 8, further comprising the steps of placing filter fabric over said second layer of solid rubber particle fill in said trench, and thereafter filling said trench with soil.

10. The method of claim 8, wherein said solid rubber particle fill comprises shredded scrap tires.

11. The method of claim 10, wherein said shredded scrap tires comprise particles having dimensions of approximately 2 inches by 2 inches by ½ inch.

12. The method of claim 8, wherein said drain tile extends an entire length of said trench and is located near a lowest extent of said trench.

* * * * *